US006708970B2

(12) United States Patent
Valterio et al.

(10) Patent No.: US 6,708,970 B2
(45) Date of Patent: Mar. 23, 2004

(54) SUPPLY DEVICE FOR A MACHINE WORKING CARDBOARD SHEETS

(75) Inventors: Roberto Valterio, Ollon (CH); Valery Naula, Yverdon-les-Bains (CH)

(73) Assignee: Bobst S.A. (CH)

( * ) Notice: Subject to any disclaimer, the term of this patent is extended or adjusted under 35 U.S.C. 154(b) by 20 days.

(21) Appl. No.: 10/232,013

(22) Filed: Aug. 29, 2002

(65) Prior Publication Data

US 2003/0057631 A1 Mar. 27, 2003

(30) Foreign Application Priority Data

Aug. 31, 2001 (CH) ..... 2001 1628/01

(51) Int. Cl.[7] ..... B65H 3/04

(52) U.S. Cl. ..... 271/35; 414/797.5; 414/797.6; 271/10.06; 493/122; 493/125

(58) Field of Search ..... 271/35, 10.06; 493/122, 125, 180, 182, 123, 124, 126; 414/797.5, 797.6, 797.7

(56) References Cited

U.S. PATENT DOCUMENTS 3,612,512 A * 10/1971 Lang ..... 271/35
4,200,033 A 4/1980 Labombarde
4,681,311 A * 7/1987 Sardella ..... 271/11
5,713,718 A * 2/1998 Okura et al. ..... 414/797.9
6,186,493 B1 * 2/2001 Toriyama ..... 271/35

FOREIGN PATENT DOCUMENTS

| | | |
|---|---|---|
| CH | 424448 | 5/1967 |
| CH | 493396 | 7/1970 |
| CH | 493396 | 8/1970 |
| EP | 0267665 | 5/1988 |

* cited by examiner

*Primary Examiner*—Donald P. Walsh
*Assistant Examiner*—Kaitlin Joerger
(74) *Attorney, Agent, or Firm*—Ostrolenk, Faber, Gerb & Soffen, LLP

(57) ABSTRACT

A supply device for a machine working cardboard sheets. At least one conveying unit for the conveyance one by one of the sheets. A hold-down stop for preventing conveyance of a pile of the sheets above the conveying unit while permitting conveyance of the bottom sheet. A plurality of rising units at the conveying unit, the raising units being alternatively moveable by pivoting between an upraised position above the upper level of the conveying unit, and a lowered position at the highest aligned with that upper level. Each rising unit is connected to a programmable control unit in order to provide a single command respectively for each one of the rising units. An adjustable height wear surface shoe on each rising unit.

15 Claims, 6 Drawing Sheets

SUPPLY DEVICE FOR A MACHINE WORKING CARDBOARD SHEETS

BACKGROUND OF THE INVENTION

The present invention relates to a supply device for a machine working cardboard sheets, comprising at least one conveyance unit for the conveyance one by one of said sheets, driving means for these conveyance units, at least one hold-down stop of a pile of said sheets above said conveyance units and at least one raising unit connected to each conveyance unit, these raising units being alternatively movable between two restricted positions, one position above the upper level of said conveyance units, the other one where they are lightly aligned according to this upper level.

Such known devices, that is to say the ones described in patents CH-424 448 and CH-493 396 are generally used for the sheet by sheet infeed of cardboard blanks in folder-gluers. The pile of cardboard blanks is alternatively raised and lowered so that the bottom of this pile travels from a level located above the conveyance units to a level located nearly at the upper level of these conveyance units, engaging thus alternatively the lower blank of the pile with the conveyance units intended to feed the folder-gluer with these blanks one by one.

The raising mechanisms of these known devices are controlled either by cam or pneumatic cylinder. These actuating mechanisms are connected to a cradle supporting all raising units, so that the latter are travelling according to one and single movement while raising the pile simultaneously and indistinctly on its whole surface. However, when the shapes of the blanks from which their respective lengths of the various parts into the conveying direction of these blanks strongly vary, i.e. in case of blanks of boxes with covers, the simultaneous rising of all the parts of the blank is not adapted. Thus, when the body of the box leaves the conveyance units, it is necessary to prevent the box of the next blank from engaging with these conveyance units by raising it, but on the contrary, the blank part including the cover still remains thus under the pile, so that it has to remain engaged with the conveyance units until it is released from the pile. The known devices are obviously not intended to deal with this problem, so that in case of blanks like the abovementioned ones, the latter seem to be turning instead of remaining well-aligned in the axis of the conveyor belts.

SUMMARY OF THE INVENTION

The aim of the present invention is to overcome at least partly the abovementioned disadvantages.

To this end, the present invention relates to a supply device for a machine working cardboard sheets wherein the conveyance of a cardboard sheet is selectively controllable by rising units that either keep the sheet off the conveyance device or permit it to settle on the conveyance device at the appropriate time. A plurality of rising units are spaced across the conveyance direction. Each rising unit may pivot up and down above the conveyance unit. Upward pivoting of a rising unit prevents contact between a blank and a conveyance unit, and lowering the unit or the arm to or below the height of the conveyance unit permits the contact that causes the sheet to be conveyed. Selective operation of different ones of the sets of the conveyance units by an appropriate control assures that an irregularly shaped blank will be contacted by a conveyance unit at the appropriate times and not be contacted prematurely by a conveyance unit which might cause the blank to turn. There is a set of shoes at each of the conveyance units areas that are operable periodically above the respective conveyance unit to reestablish a correct top height of the rising unit, as the shoe wears, during repeated use.

Thanks to this device, it is possible to differentiate the moving of each pair of rising units according to the geometry of the blank to be feeded into the folder-gluer. The conveyance of these blanks is thus improved; the latter remain well-aligned compared to the transport axis. This device also ensures to put out of operation the rising units of the conveyance units which would be outside the pile of blanks. This permits the increase of the security and the decrease of the use of compressed air as well as the noise decrease. The conductor is able to store the various mechanisms of the rising units according to the sorting of these mechanisms and the geometry of the blank(s) to be feeded into the folder-gluer.

These advantages are more particularly profitable to three kinds of blanks, first of all to the 4-corner blanks for which the device according to the invention permits a more regular starting rate of the blanks.

The second kind of 6-corner blanks is appreciably similar to the first said one for which the advantages of the device according to the invention are the same.

The third kind of blanks profitting of these advantages are the so-called "crash-lock bottom blanks", that is to say the box blanks for which the bottom of the box itself is automatically shaped at the time of the setting into volume, and in particular the disproportionate crash-lock bottom blanks with covers for which the device of the invention permits the decrease of the phenomenon of setting in skew the blanks at the starting time.

Lastly, the device of the invention allows considering many up-to-date unknown possibilities, such as the simultaneous control of several blanks or of one blank and its reinforcement.

BRIEF DESCRIPTION OF THE DRAWINGS

The enclosed drawing shows, schematically and as an example, an embodiment of the conveying device of the invention.

DESCRIPTION OF THE PREFERRED EMBODIMENT

Figure 1:
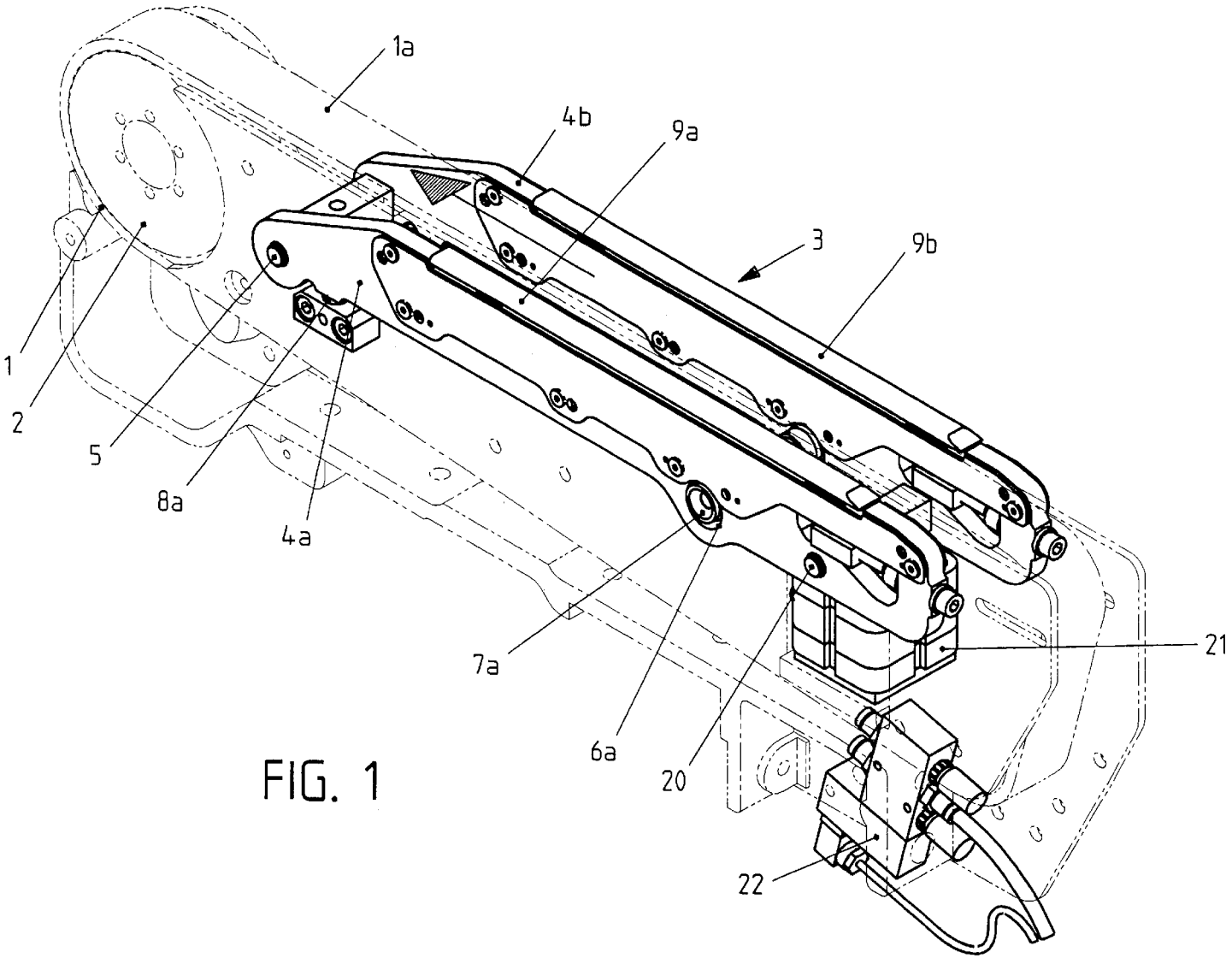
FIG. 1 is a prospect sight of a conveying unit of this supply device.

The supply device of the invention comprises at least one conveying unit illustrated by FIG. 1. This conveying unit comprises primarily one known conveying mechanism, including a conveyor belt 1 conveyed by a pulley 2, the conveying belt 1 being however guided by rollers (not represented). The conveying belt 1 of the conveying unit can be involved either in continuous mode, or in alternative mode. It can be either shaped like an endless belt in case of a continuous driving mode, or shaped like a belt rod of a defined length, secured at its two ends to pulleys in case of an alternative driving mode. This conveying unit is illustrated in mixed features in order to better emphasize a rising unit 3 drawn in continuous features, which comprises, according to the invention, two arms 4*a*, 4*b* lengthened-shaped, settled on each side of the endless conveying belt 1 and obviously extending parallel to the conveying rod 1*a* of this conveying belt 1.

The two arms 4*a*, 4*b* of the rising unit 3 are assembled in such a way to pivot around an axle 5. Each arm 4*a*, 4*b* comprises an aperture, of which only one 6*a* is shown in FIG. 1. Each one of these apertures is crossed by a cylindrically shaped stop, of which only one 7*a* is shown on FIG. 1. These stops 7*a* have a diameter appreciably smaller than the one of the apertures 6*a*, so that the moving of the two arms 4*a*, 4*b* of the rising unit 3 is limited both directions due to the contact between the edges of the apertures 6*a* and these stops 7*a*. In order to reduce the noise and vibrations, the stops 7*a* are wrapped by a ring made of a shock absorber material, such as polyurethane 90° sh.

A pair of prestressed stops, of which only one 8*a* is shown in FIG. 1 is located near the pivoting axis 5 of these arms 4*a*, 4*b*. This pair of stops 8*a* is made of elastomer and is adjusting the difference which can occur on the swivelling axis 5 of the arms 4*a*, 4*b*. If one refers again to FIG. 1, he will note that a transverse rod 20 is connecting the arms 4*a*, 4*b* together. This rod 20 is also used for connecting these arms 4*a*, 4*b* to the rod of an actuator. In the present embodiment, this actuator is a pneumatic acting cylinder 21 controlled by an electro-valve 22. This cylinder 21 is intended for moving the arms 4*a*, 4*b* from one to another utmost position defined by the aperture 6*a* and the stop 7*a*. It is obvious that other kind of actuators such as a linear motor could be selected to deal with this work.

Figure 2:
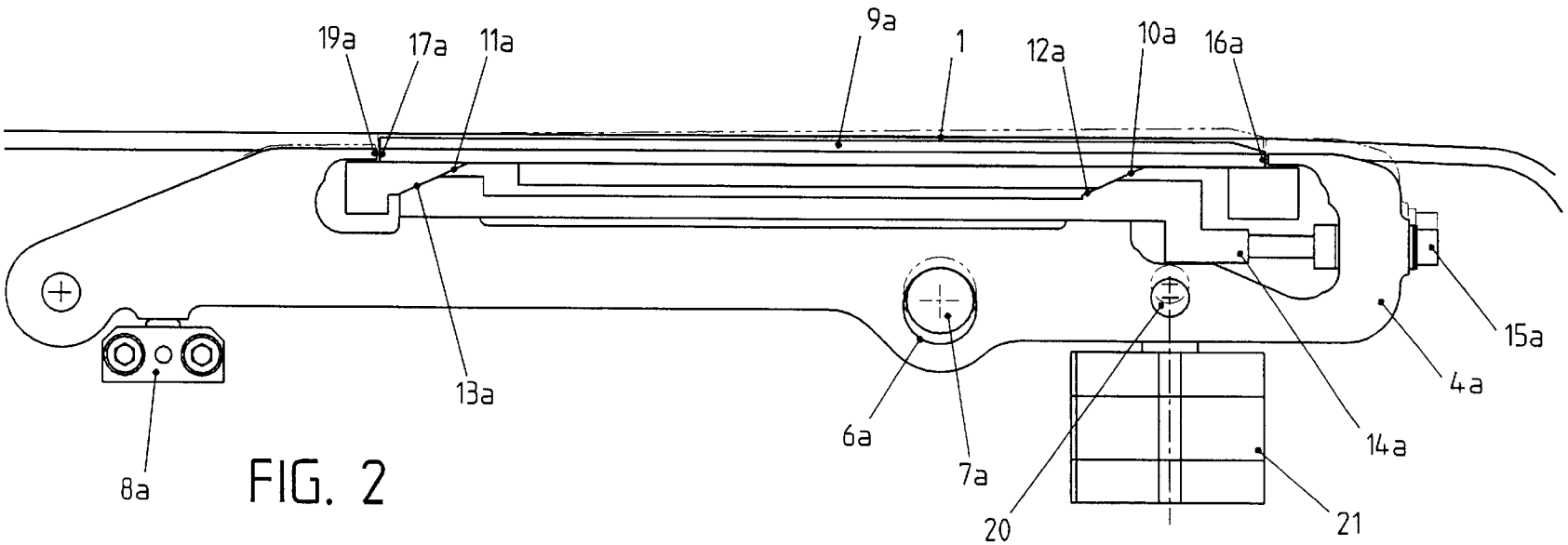
FIGS. 2 and 3 are partial sights of the side view of the conveying unit of FIG. 1 in two different positions.
Figure 3:
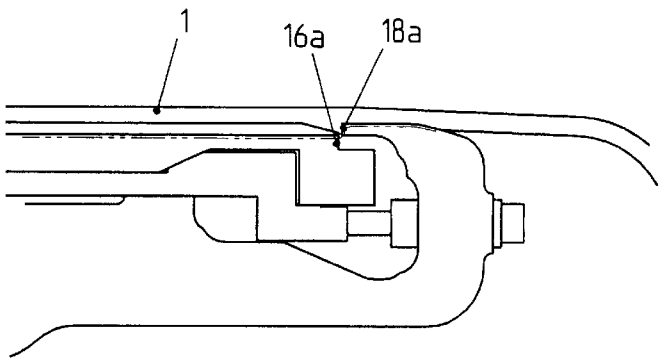

The upper part of each arm 4*a*, 4*b* is equipped with a shoe 9*a*, 9*b*, which is adjustable by means of a mechanism illustrated in FIGS. 2 and 3. The lower side of each shoe 9*a*, 9*b*, i.e. the shoe 9*a*, shows two inclined planar surfaces 10*a*, 11*a* located nearly to each one of its ends. Each one of the inclined planar surfaces 10*a*, 11*a* is leaning on another planar surface 12*a*, respectively 13*a* of a slide 14*a* likely to be longitudinally moved by a setting screw 15*a* arranged swivelling inside the arm 4*a*. A same adjustment system is located in the arm 4*b*. While screwing the setting screw 15*a*, one moves the slide 14*a* in both directions, whereas the shoe 9*a* is longitudinally secured on the arm 4*a* by two recesses 16*a*, 17*a* located on the shoe and cooperating with two longitudinal stops 18*a*, respectively 19*a*, located on the arm 4*a*. Thus, the level of the shoes 9*a*, 9*b* can be improved between the two opposite positions illustrated on FIGS. 2 and 3. Thanks to this adjustment system the level of the shoes 9*a*, 9*b* can be improved according to the wear of the conveying belts 1. Indeed, these conveying belts 1 intended for the blanks to successively leave the pile towards the processing machine for the latter undergo a strong wear due to the friction caused by each blank which left the pile. It is thus useful to adjust the level of the shoes 9*a*, 9*b* in relation to this wear.

Figure 4:
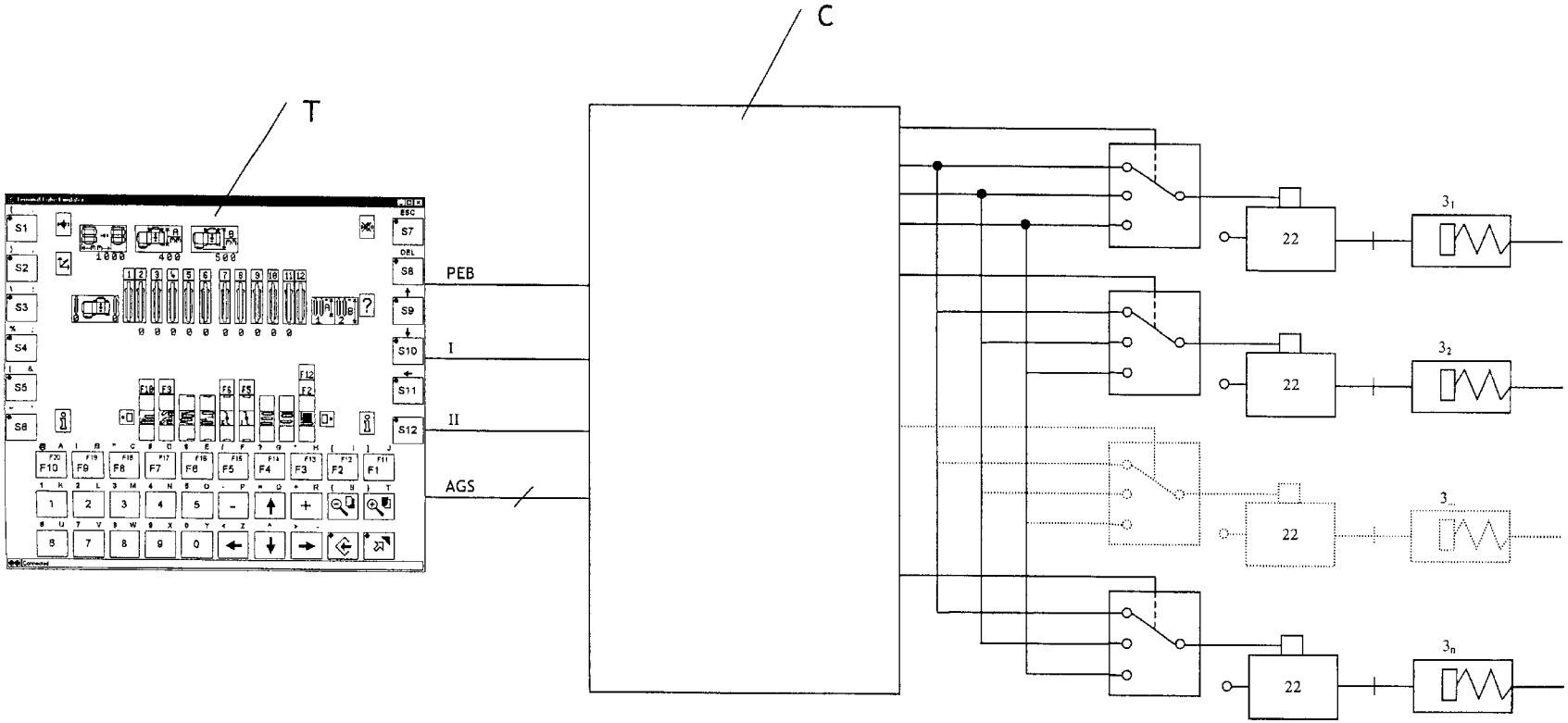
FIG. 4 is a block diagram of the control unit of the rising mechanisms of the rising unit.

The block diagram of FIG. 4 refers to the control station of the conveying device and especially to the control of the acting cylinders 21 according to the shape of the blanks which have to be successively fed into the processing machine for these blanks. This control station comprises a terminal T connected to a computer C by means of four outputs, one PEB output needed to point out the spacing value between the blanks, the outputs I and II related to their respective values (in particular the sizes in the conveying direction of the conveying device) of parts I and II of the blanks (as it will be described with FIGS. 5 to 7) and finally an output AGS related to the groups of control mechanism for the arms 4*a*, 4*b* of the rising unit which have to be simultaneously actuated for the rising of the parts I, respectively parts II of each blank.

Starting from the provided data and parameters of the conveying device and of the machine into which the blanks must be fed (especially the traveling speed of the latter), the computer C selectively controls the electro-valves 22 of the acting cylinders 21 of the various raising mechanisms $\mathbf{3}_1$ to $\mathbf{3}_n$, of the arms 4*a*, 4*b* of the rising device 3 of the abovementioned supply device.

Figure 5:
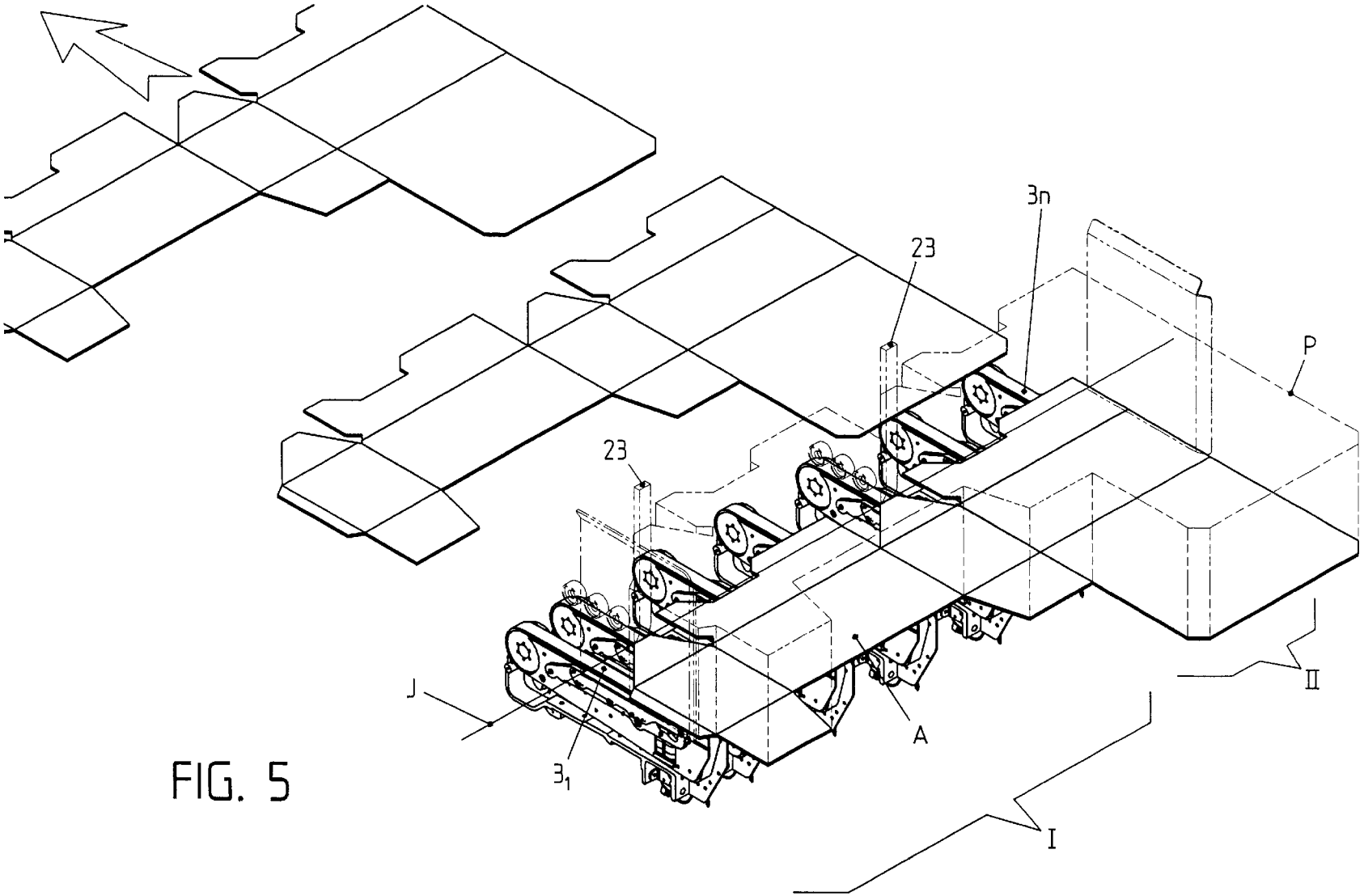
FIGS. 5 to 7 are prospect sights of the conveying device illustrating three phases of an infeed cycle of a blank into a folder-gluer.
Figure 6:
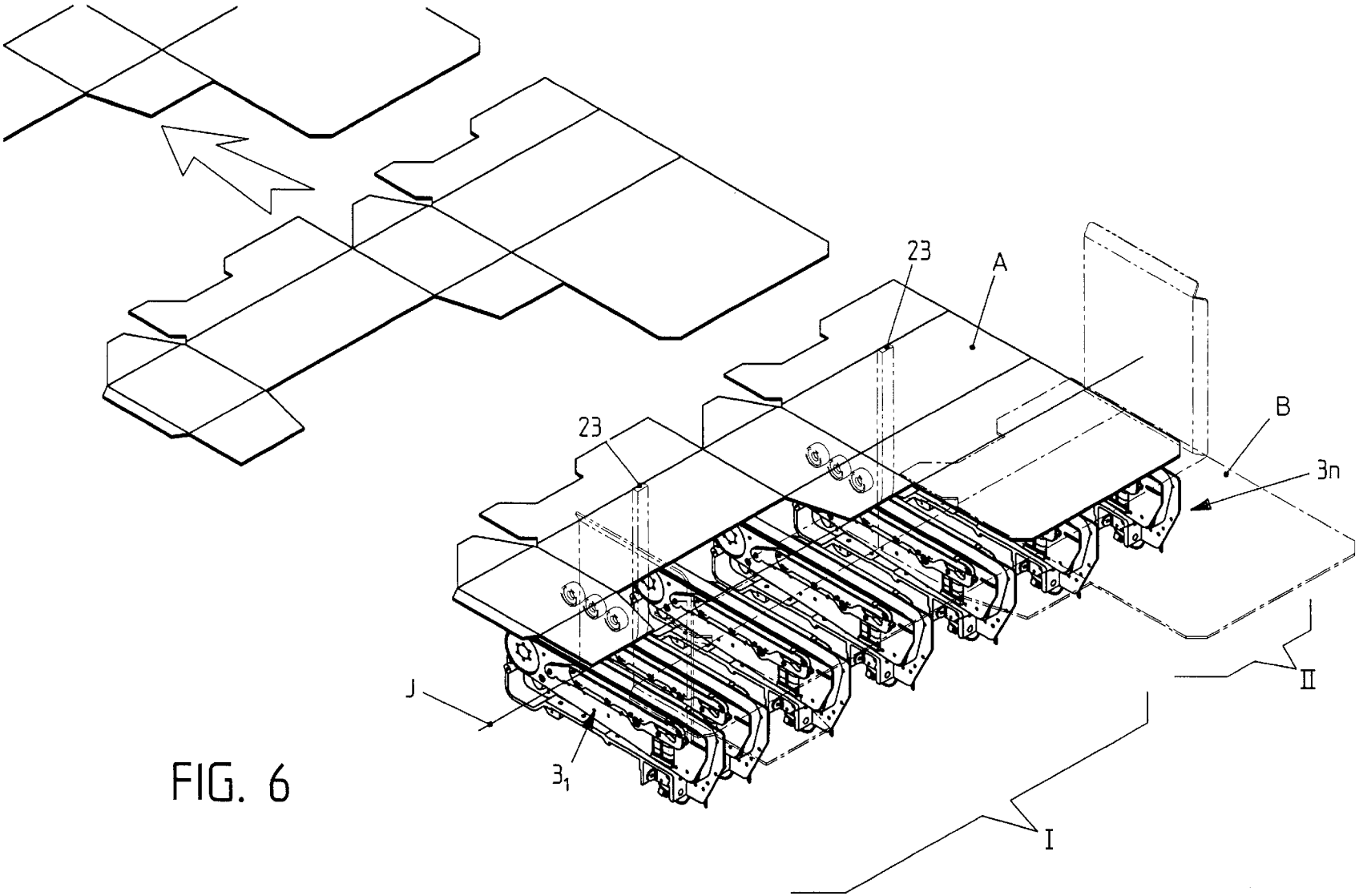
Figure 7:
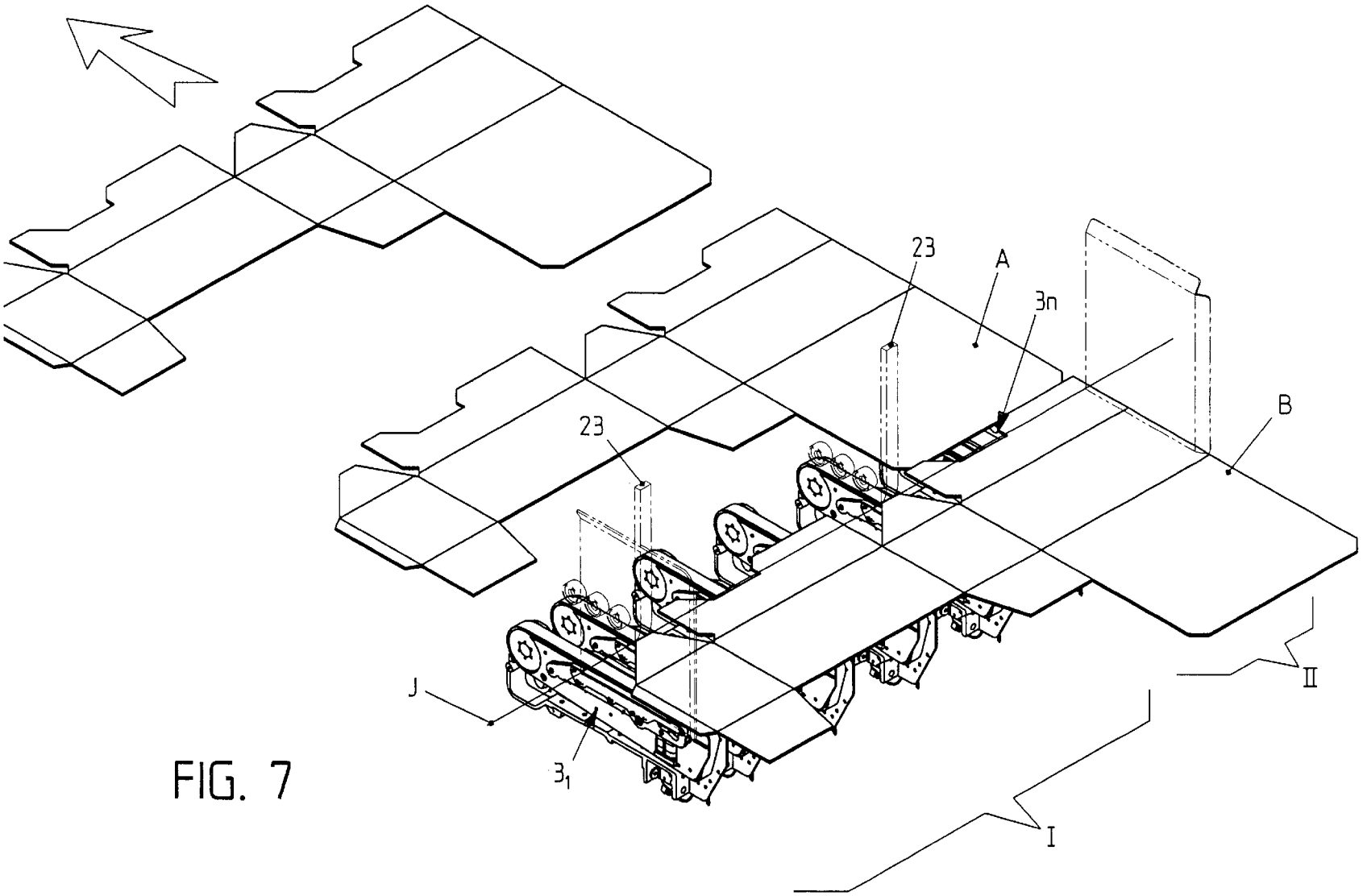

Let us now explain an infeed cycle of a blank into the processing machine by means of FIGS. 5 to 7 illustrating the different phases.

FIG. 5 relates to phase 1 while all the arms 4*a*, 4*b* of the rising units 3 are lowered, so that the blank A is in touch with all the conveying belts 1 and is thus conveyed. The blank A located at the bottom of the blanks pile P is separated from the other blanks.

With the second phase illustrated on FIG. 6, the end of the blank body A has reached the gauge line J, i.e. the one by one starting line for the blanks of the pile to be conveyed towards the processing machine. This line is finalized by stops 23, 50 called infeed gauges, whose bottom is rounded to permit an easier sorting of the blanks of the pile P and whose lower part ends nearly the conveying belt 1 likely related to the thickness of a cardboard blank. These blanks can thus leave the pile one by one to be fed into the processing machine.

At this stage of the infeed process, the arms 4*a*, 4*b* of the rising units 3 located into the part I of the blank must raise to prevent the next blank B from being in touch with the conveying belts 1; this would have as a result to put it in skew. The arms 4*a*, 4*b* of the rising units 3 located in part II of the blank A related to the cover, remain lowered since this part of the blank is still under the pile P.

At the next phase illustrated on FIG. 7, when the cover end (i.e. part I of the blank A) has reached the gauge line J, the arms 4*a*, 4*b* of the rising unit 3 located in part II of the blank A are moved towards the top so that the whole surface of the next blank B is set apart from the conveying belts 1, while preventing this blank B from travelling towards the processing machine.

At a given moment, all the arms 4*a*, 4*b* of the rising units 3 are lowered, which is preparing the next blank B to leave the pile.

The example according to the invention refers to the control of the arms 4*a*, 4*b* of the rising units 3 in two phases which corresponds to the two parts I and II of the blanks. The invention is obviously not restricted to this example. If necessarily required, each rising unit 3 can be controlled at a different time or can be neutralized. In the same way, the number of the rising units 3 can vary, especially according to the width of the conveying device.

What is claimed is:

1. Supply device for a machine working cardboard sheets, comprising at least one conveyance unit for the conveyance one by one of said sheets, driving means (2) of the conveyance unit, at least one hold-down stop (23) of a pile (P) of said sheets above said conveyance unit, at least one rising unit (3) alternatively movable between two restricted positions, one position above the upper level of said conveyance unit, the other one lightly aligned according to this upper level, characterized by the fact that each rising unit (3) is connected to a programmable control station (T, C) in order to permit the single command of each one of the raising units (3).

2. Device according to claim 1, characterized by the fact that said rising units (3) comprise two arms (4*a*, 4*b*) parallelly extending to said conveying units and swivelling assembled at one of their ends around an axis (5), each pair of said arms (4*a*, 4*b*) of the rising units (3) being connected to an actuator likely to make it swivelling between said two restricted positions, this actuator being infeeded by an electro-valve (22) connected to said programmable control station (T, C).

3. Device according to claim 1, characterized by the fact that when the arms (4*a*, 4*b*) of the rising units (3) are appreciably aligned compared to the upper level of the conveying units, an elastic stop (8*a*) is settled to be constraigned in said position of said arms (4*a*, 4*b*).

4. Device according to claim 3, characterized by the fact that each one of said arms (4*a*, 4*b*) of the rising units (3) carries a rising shoe (9*a*, 9*b*) connected to said arms (4*a*, 4*b*) by setting means (10*a*–15*a*) for the level of said rising shoe (9*a*, 9*b*) according to said arms (4*a*, 4*b*).

5. Device according to claim 2, characterized by the fact that the actuator is a pneumatic cylinder (21).

6. Device according to claim 5, characterized by the fact that the actuator is a linear motor.

7. A supply device for supplying cardboard sheets for subsequent use, the supply device comprising:

a conveying unit for conveying one cardboard sheet at a time from the bottom of a pile of the sheets in a conveying direction; the conveying unit having an upper level on which cardboard sheets are conveyed;

a hold down stop for the pile of the sheets placed for blocking movement of the pile by the conveying unit while permitting conveying of the sheet at the bottom of the pile by the conveying unit;

a plurality of rising units spaced across the conveying direction and each rising unit being moveable alternately between an upraised position above the upper level of the conveyor unit for keeping the cardboard sheet, which is then in position to be contacted by the conveying unit, out of contact with the conveying unit at an area near the rising unit across the conveying direction and a lowered position which at the highest is aligned with the upper level of the conveying unit which permits a cardboard sheet to contact and be conveyed by the conveyance unit at the area near the rising unit across the conveying direction; each rising unit being independently controllable;

a programmable control station connected to each of the rising units for providing a respective command to each of the rising units for selectively moving the rising unit between the positions thereof, such that selected ones of the rising units may be caused to rise to the upraised position while others are not simultaneously caused to rise.

8. The supply device of claim 7, wherein the control station provides a single command to each rising unit for causing the rising unit to move.

9. The supply device of claim 7, wherein each rising unit comprises an arm extending along the direction of conveyance by the conveying unit; the arm having opposite ends; a swivel axis at one end of the arm about which the arm may swivel; an actuator to which the arm is connected for swivelling the arm between the two positions of the raising unit.

10. The supply device of claim 9, wherein each rising unit comprising two of the arms parallel to each other, on the swivel axis which is in common for the two arms and the arms are connected to be moved together by the actuator.

11. The supply device of claim 9, further comprising, an electrovalve control connected to the programmable control station and operably connected to the actuator.

12. The supply device of claim 8, further comprising an elastic stop position to be engaged by the arm of the rising unit when the arm of the rising unit has been moved to the lowered position.

13. The supply device of claim 9, further comprising a respective raisable shoe on the arm and providing a surface of the arm on which a carton blank is supported with the arm in the upraised position; and a respective height adjustment device connected with each of the shoes, for setting the height of the shoe at or above the respective arms.

14. The device according to claim 8, wherein the actuator is a pneumatic cylinder.

15. The device according to claim 8, wherein the actuator is a linear motor.

* * * * *